US005678635A

United States Patent [19]

Dunlap et al.

[11] Patent Number: 5,678,635

[45] Date of Patent: Oct. 21, 1997

[54] THRU TUBING BRIDGE PLUG AND METHOD

[75] Inventors: Kenneth S. Dunlap; Britt O. Braddick, both of Houston, Tex.

[73] Assignee: TIW Corporation, Houston, Tex.

[21] Appl. No.: 572,786

[22] Filed: Dec. 15, 1995

Related U.S. Application Data

[63] Continuation-in-part of Ser. No. 223,704, Apr. 6, 1994, Pat. No. 5,566,762.

[51] Int. Cl.[6] ..... E21B 23/06; E21B 33/129

[52] U.S. Cl. ..... 166/387; 166/123; 166/134; 166/140

[58] Field of Search ..... 166/387, 386, 166/134, 135, 138, 140, 123, 297, 382, 117.5, 117.6, 208, 217, 181, 182, 242, 243; 175/258, 262, 274, 275, 276

[56] References Cited

U.S. PATENT DOCUMENTS

| | | | |
|---|---|---|---|
| 3,993,128 | 11/1976 | Braddick | 166/212 |
| 3,999,605 | 12/1976 | Braddick | 166/216 |
| 4,548,265 | 10/1985 | Luke | 166/387 X |
| 4,688,642 | 8/1987 | Baker | 166/382 |
| 4,898,245 | 2/1990 | Braddick | 166/387 |
| 4,942,924 | 7/1990 | Duncan | 166/382 |
| 5,010,958 | 4/1991 | Meek et al. | 166/382 |
| 5,154,231 | 10/1992 | Bailey et al. | 166/117.6 |
| 5,168,942 | 12/1992 | Wydrinski | 175/258 |
| 5,193,620 | 3/1993 | Braddick | 166/117.5 |
| 5,224,540 | 7/1993 | Streich et al. | 166/134 X |
| 5,346,017 | 9/1994 | Blount et al. | 166/117.6 |

FOREIGN PATENT DOCUMENTS

| | | |
|---|---|---|
| 0 141 726 | 5/1985 | European Pat. Off. . |
| 1 257 790 | 12/1971 | United Kingdom . |

*Primary Examiner*—Terry Lee Melius
*Attorney, Agent, or Firm*—Browning Bushman

[57] ABSTRACT

A bridge plug assembly 10 contracts radially inwardly to pass through tubing string T and then expands radially outwardly in response to axially compressive forces to set within a casing string C. Upper and lower independently moveable slips 52 and 54 of the anchor mechanism 12 engage casing C. The packoff mechanism 14 includes a plurality of upper sealing members 160, 162, 164 and a plurality of lower sealing members 166, 168, 170 having varying elasticity such that at least some of the sealing members overlap other sealing members when the bridge plug 10 is compression set in the casing C. The bridge plug assembly 10 is retained in a contracted position for passing downwardly through tubing T, then expanded for sealing engagement with casing C. The bridge plug 10 may be run-in with a setting tool ST and may be subsequently released by a releasing tool RT to drop within the well.

35 Claims, 7 Drawing Sheets

THRU TUBING BRIDGE PLUG AND METHOD

RELATED APPLICATIONS

This application is a continuation-in-part of U.S. patent application Ser. No. 08/223,704 filed Apr. 6, 1994 and entitled THRU TUBING TOOL AND METHOD, now U.S. Pat. No. 5,566,762.

FIELD OF THE INVENTION

The present invention relates to a compression set bridge plug of the type commonly used in hydrocarbon recovery operations to plug an oilfield tubular. More particularly, this invention relates to a bridge plug employing resilient elastomeric compressive sealing members and anchoring slips, and to a method of forming a bridge plug in a manner which allows the bridge plug to be transmitted through a relatively small diameter tubing and thereafter plug a relatively large diameter oilfield tubular below the tubing.

BACKGROUND OF THE INVENTION

Conventional bridge plugs are mechanical devices, including anchoring mechanism and compressive set resilient packoff seals, which are commonly used in hydrocarbon recovery operations and other downhole well operations for plugging tubular members. In some applications, a bridge plug is used to prohibit flow or completely isolate a lower interval from an upper interval of a well. In other instances, when supplied with an internal passage and choke, a bridge plug may be used to assist in reducing or controlling flow through an oilfield tubular at a desired depth.

In some applications, it is desirable to install a bridge plug within a large diameter tubular, such as casing string, at point or depth below which a small diameter tubular, such as a production tubing, has previously been installed. In order to avoid pulling the tubing string from the casing, setting a bridge plug, and later replacing the tubing, all at great expense, bridge plugs with inflatable resilient members or bladders were developed. These inflatable bridge plugs were of a sufficiently small outside diameter to permit passage through the tubing string and thereafter, when positioned within the larger internal diameter casing, could be inflated to form a sealing bridge plug within the casing. On occasions, the inflatable members or bladders were furnished with anchoring stays designed to grip the internal diameter of the casing and prevent the inflated bladder from movement within the casing in response to pressure therein. Under prolonged and especially cyclic operations within the well, inflatable bridge plugs have tended to fail, sometimes due to a malfunction of their valving systems which maintain the inflation. More commonly, inflatable bridge plugs fail due to failure of the bladder, which commonly results from delamination or puncture of the resilient bladder, thereby causing the bladder to deflate and cease to function as a bridge plug within the casing.

There is a need in the hydrocarbon recovery industry for an improved bridge plug and method of forming a bridge plug that will allow for the installation of a compressive set bridge plug at a desired depth in a casing in which a smaller diameter tubing is positioned without the necessity of first retrieving or removing the smaller diameter tubing positioned in the well above that desired depth. Those skilled in the art have long sought and will appreciate the present invention which provides solutions to these and other problems.

SUMMARY OF THE INVENTION

The downhole compression set bridge plug and method of the present invention may be reliably used to plug a tubular disposed in a wellbore. For this purpose, the method allows for passing the bridge plug downhole through a small diameter tubular and then for setting the bridge plug within a large diameter tubular. The large diameter tubular may have the lower end of the small diameter tubular supported therein. The method generally includes connecting the downhole bridge plug to a wellbore transport and setting member. The downhole bridge plug and the wellbore transport and setting member are passed downhole through the small diameter tubular, and are positioned at a desired depth within the large diameter tubular below the lower end of the small diameter tubular. A plurality of axially spaced elastomeric sealing members are moved to a radially overlapping position to form an effective seal between the body of the bridge plug and the large diameter tubular, and anchoring slips on the downhole bridge plug are expanded to securely engage an inner wall of the large diameter tubular. The sealing members and the anchoring slips on the bridge plug may thereafter be retracted for dropping and/or moving and ejecting the bridge plug within the wellbore.

A plurality of upper movable members are slidably secured to the body portion of the bridge plug and are movable between a set position and an unset position. Upper and lower slips are slidably movable between a radially outwardly set position and a radially inwardly unset position. The downhole tool includes a plurality of upper and a plurality of lower sealing members each having varying degrees of hardness or elasticity. A maximum elastic sealing member expands radially outward to overlap with the medium elastic sealing member, which subsequently expands to overlap the minimum elastic sealing member.

It is an object of the present invention to provide an improved compression set bridge plug and method of setting a bridge plug within an oilfield tubular. It is another object of this invention to provide a bridge plug that may be initially positioned downhole by passing through a small tubular, such as a tubing string, that opens up into a large diameter tubular, such as a casing string.

A feature of the present invention is a bridge plug with an improved expandable and retractable slip assembly. Another feature of this invention is a bridge plug with multiple sealing members each having a desired hardness or elasticity. A soft or more elastic sealing member may expand radially outward and overlap a harder or less elastic sealing member, thereby forming a reliable seal with the large diameter casing. Still another feature of the invention is the use of rigid pivot members at the axial ends of the sealing members in cooperation with overlapping deformable members to prevent extrusion of the sealing member.

A significant advantage of the present invention is the elimination of the need to remove a tubing string before positioning a compression set bridge plug in a casing below the tubing.

These and further objects, features, and advantages of the present invention will become apparent from the following drawings, the description given herein, and the appended claims.

While the present invention will be described in connection with presently preferred embodiments, it will be understood that it is not intended to limit the invention to those embodiments. On the contrary, it is intended to cover all alternatives, modifications, and equivalents included within the spirit of the invention and as defined in the appended claims.

DETAILED DESCRIPTION OF THE PREFERRED EMBODIMENTS

The present invention provides a thru tubing bridge plug for plugging a wellbore tubular. The bridge plug may be lowered through a small diameter tubular string and compression set by applying axially directed compressive forces for plugging a large diameter tubular string. The bridge plug may subsequently be unset and dropped or may be moved within the wellbore and ejected from the releasing tool.

Figure 1:
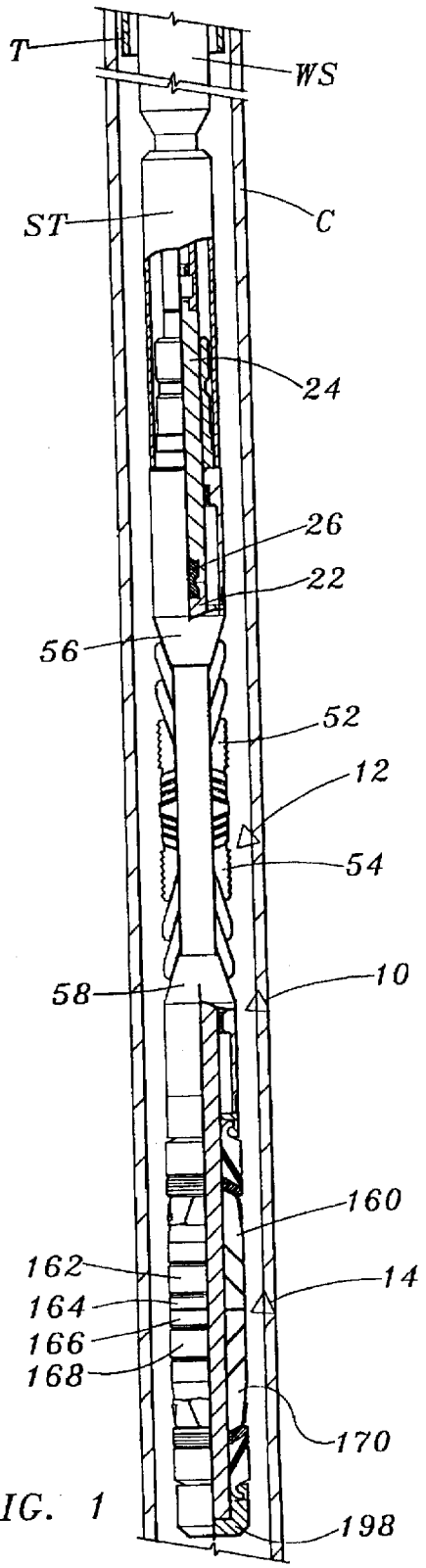
FIG. 1 is an elevational view, partially in section, of a bridge plug assembly operable to pass through a small tubing string and set within a large diameter casing string.
Figure 2:
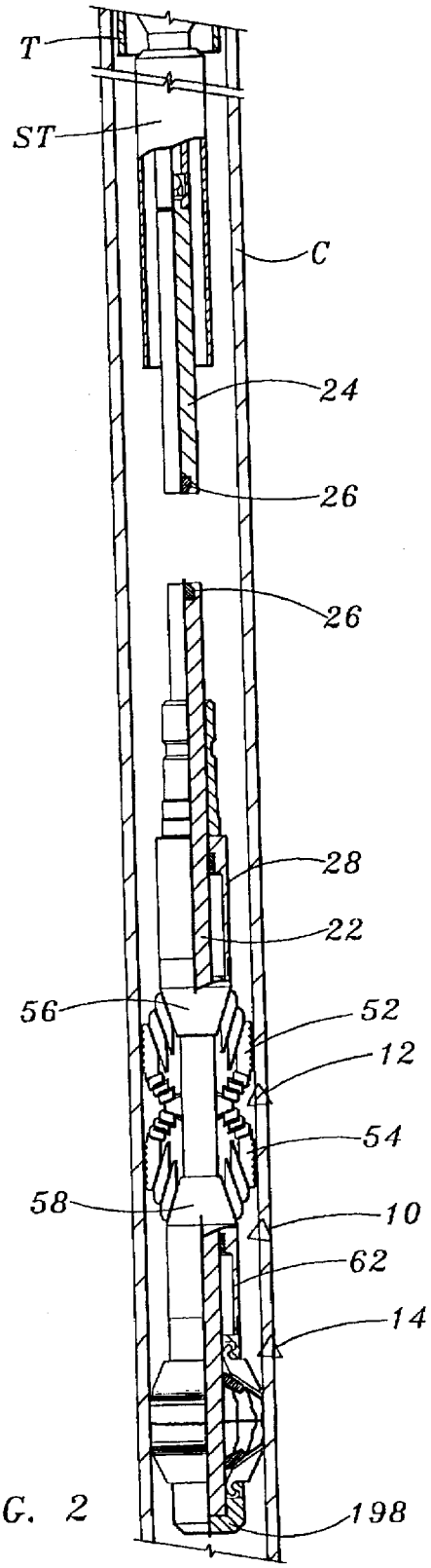
FIG. 2 is an elevational view, partially in section, illustrating the bridge plug assembly set in the casing string, with the setting tool being retrieved to the surface through small diameter tubing string.

Referring to FIG. 1, the bridge plug positioning and setting operation according to a presently preferred embodiment of the invention may proceed by lowering the bridge plug assembly 10 that is attached to a hydraulically activated setting tool ST through the bottom of the tubing T and into a casing string C schematically indicated in FIG. 1. It will be understood that the bridge plug assembly may be lowered in the well using a continuous coiled tubing string or using a jointed tubular work string WS, then set with either the hydraulically activated setting tool ST or with another type of tool useful for compression setting a bridge plug downhole. After the bridge plug has been set within the casing string, the setting tool ST and the work string WS may be removed, as shown in FIG. 2 and as described subsequently.

For convenience of understanding, descriptive terms such as "upwardly", "downwardly", and the like may be used in this specification to conveniently describe the components and operation of the bridge plug assembly in association with the accompanying drawings. It will be understood that such terms are used for explanatory purposes, and are not to be construed in any manner as limiting the invention. Those skilled in the art will recognize that the orientation and configuration of the equipment described herein may be different from that illustrated in the accompanying drawings, and that this terminology is used only for ease of understanding a preferred embodiment of the present invention. When referring to a depth in a wellbore, the length of the wellbore rather than a specific elevational depth will be assumed, so that an offset well may have a deeper depth than a vertical well even though both are at the same elevational depth. As explained subsequently, the tool of the present invention is well suited for use in deviated wells and in horizontal portions of wells. The terms "small diameter tubular" and "large diameter tubular" are relative terms commonly associated with tubing strings and casing strings, respectively. The terms may be applied, however, to any oilfield tubular members.

Referring more particularly to FIG. 1, there is shown a thru tubing bridge plug assembly 10 in accord with the present invention. Bridge plug assembly 10 has been lowered into the casing C through the tubing T by means of a work string WS. For example only, casing C may be a 7 inch O.D., 6¼ inch I.D. casing and tubing T may be a 4½ inch O.D., 4 inch I.D. tubular production string. The bridge plug 10 may have a nominal maximum O.D. of 3¾ inches for passing through the tubing T.

The range of difference between the outer diameter of the small diameter tubular, such as tubing string T, and inner diameter of the larger tubular, such as casing C, will be at least ½ inch, and typically will be about 1 inch or more. The difference between the outer diameter of 4½ inch O.D. tubing and inner diameter of a 7 inch O.D. casing is about 1¾ inches. The tool 10 is thus capable of being passed through the inner diameter of the smaller tubular which, for 4½ inch O.D. tubing, may be about 3⅞ inches and depends on the weight per foot of the inner tubular, and then expanded to set in the larger diameter tubular. Thus the expansion required for that operation for the embodiment described above is about 2½ inches. This expansion is much greater than the expansion required for full bore operations of a typical compression set slip and packoff assembly, which may be in the range of about ¼ to ⅜ inch.

The desired depth for setting the bridge plug assembly 10 may be correlated to the desired formation strata or other desired position in the wellbore in a manner known to those skilled in the art. The hydraulic setting tool ST may be supported by a work string WS that may include continuous coiled tubing or individual tubulars threadably secured together. In some cases, it may be necessary to provide a setting tool with a stroke somewhat longer than is common with conventional bridge plugs due to the need for the slips and packoff within the bridge plug assembly 10 to expand radially outwardly from a run-in position to a set position by a radial distance of greater than 1 inch, as explained above.

The bridge plug 10 includes an anchor mechanism 12 and a packoff mechanism 14 each discussed in detail below. The anchor mechanism 12 is preferably provided above the packoff mechanism 14, although in another version of the tool, the packoff mechanism may be provided above the anchor mechanism, or may be provided between the upper and lower slips on the anchor mechanism.

Figure 3:
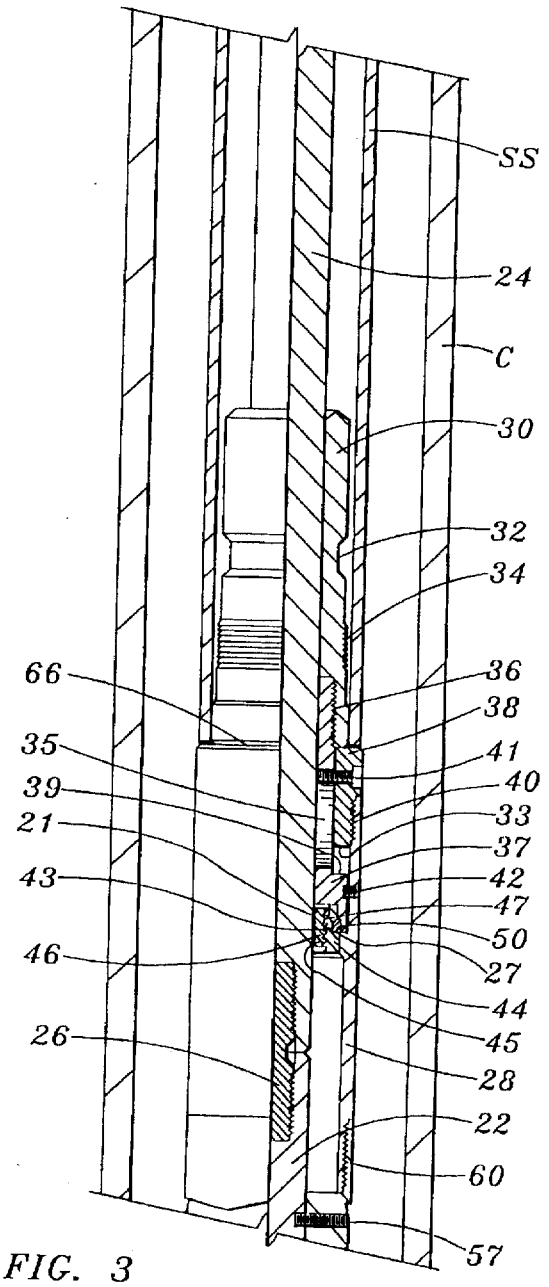
FIG. 3 is a detailed view of an upper portion of the bridge plug assembly connected to the setting tool in the run-in or unset position.

Referring to FIGS. 1 and 3, anchor mandrel 22 is secured by a shear stud 26 to mandrel adaptor 24, which is axially movable within the housing of the setting tool ST. During run-in, the weight of the bridge plug 10 is supported by shear stud 26 from the setting tool ST. Thus, when shear stud 26 shears due to a predetermined separation force applied thereto as explained subsequently, the setting tool ST will then physically separate from bridge plug 10 and may be retrieved to the surface, as shown in FIG. 2.

The bridge plug assembly 10 includes a top sub 30 which has an annular retrieving recess 32 and external threads 34. External threads 34 provide a convenient way to interconnect the bridge plug with a fishing tool in the event that a problem develops in unsetting the bridge plug assembly in the manner to be described below. The top sub 30 is threaded at 36 to releasing sleeve 37, which extends axially through and is movable axially within collar 38. Collar 38 is threaded at 40 to the sleeve 28 and is abutted at its upper end 66 by the lower end of top sub 30 and by the lower end of the setting sleeve SS element of the setting tool ST. The upper end 66 of collar 38 receives and transmits a downward force from the setting tool ST to set the bridge plug as will be explained below. Releasing sleeve 37 is maintained in non-rotational relationship with collar 38 by threaded pin 41, which extends from collar 38 into the upper end of elongated slot 35 within sleeve 37. Releasing sleeve 37 is releasably connected to the sleeve 28 by shear pin 42, and contains an annular recess at its lower end which houses ratchet ring housing 44 as shown in FIG. 3.

Ratchet ring housing 44 has internal buttress threads 45 which engage and mate with external buttress threads 47 on ratchet ring 46. Ratchet ring 46 has internal buttress threads 21 which mate and engage with external buttress threads 48 (see FIG. 4) on mandrel 22 during setting of the bridge plug so as to releasably lock the bridge plug 10 in a set position. The internal buttress threads 45 and external threads 47 of ratchet ring housing 44 and ratchet ring 46, respectively, traditionally have depths equal to three times the depth of internal buttress thread 21 and external buttress thread 48 shown on the ratchet ring 46 and mandrel 22, respectively. The ratchet ring 46 has an annular C-ring configuration. The external buttress thread 47 of ratchet ring 46 have a loosely fitted engagement with the internal buttress thread 45 of the ratchet ring housing 44 to permit outward radial flexing of the ratchet ring 46 within the ratchet ring housing 44 as the ratchet ring traverses the external buttress threads 48 of the mandrel 22 during the setting operation.

C-ring 50 is releasably retained in external annular groove 43 of the ratchet ring housing 44 by the enlarged lower annular recess of releasing sleeve 37. In turn, this retains ratchet ring housing 44 within the lower annular recess of releasing sleeve 37 during setting of the bridge plug assembly 10. In the run-in and set positions, the external portion of C-ring 50 overlaps the reduced internal annular shoulder 27 of sleeve 28 so as to maintain releasing sleeve 37, C-ring 50, ratchet ring housing 44 and sleeve 28 in a releasably locked relationship with one another between reduced annular shoulder 27 and shear pin 42.

Figure 4:
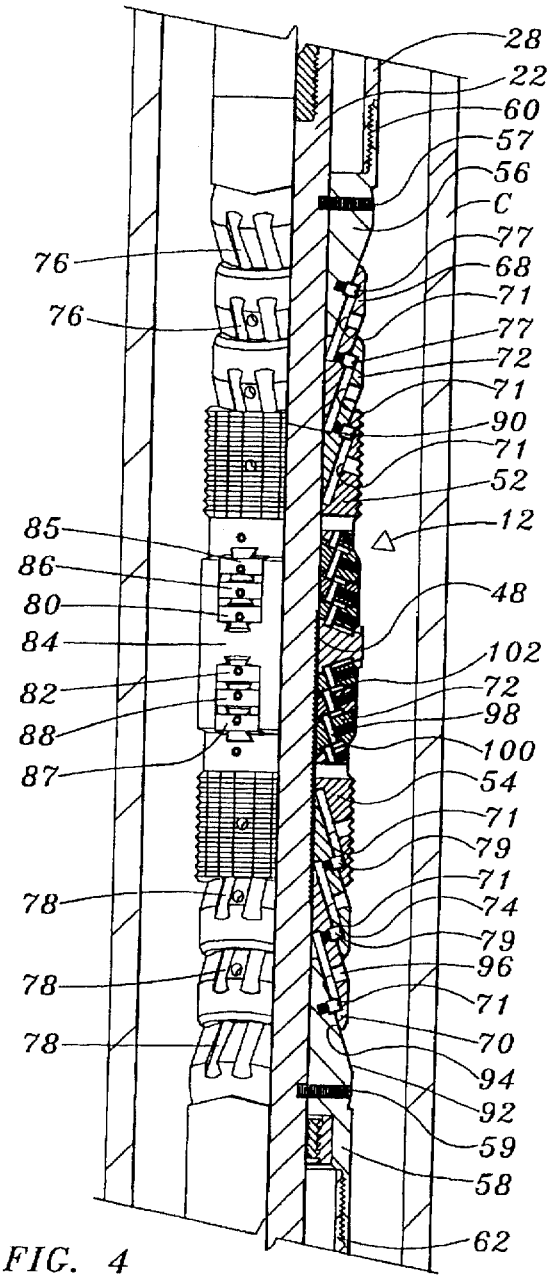
FIG. 4 is a detailed view of the anchor mechanism in the run-in or unset position.

Upper and lower slips 52 and 54, respectively, of the anchor mechanism 12 are in the unset, collapsed, or retracted position as shown in FIGS. 1 and 4 to allow the bridge plug assembly 10 to be lowered through smaller diameter tubing T into larger diameter casing C. Thus, the outer diameter of bridge plug assembly 10 is smaller than the smallest inner diameter portion of tubing T by a clearance factor that may typically be at least ⅛ inch. It will be noted that the lower sub 198 has the largest outside diameter of any component of the bridge plug assembly 10 so as to substantially prevent sharper elements, such as the metallic slips 52 and 54, from engaging the tubing or casing prior to reaching the desired setting depth within the casing C.

Upper expander 56 is threaded at 60 to sleeve 28 and is releasably connected to the mandrel 22 by upper shear screw 57. Lower expander 58 is supported on housing sub 62 (see FIGS. 4 and 5), which is positioned about the mandrel 22 and is releasably connected thereto by lower shear screw 59. As shown in FIGS. 3 and 4, mandrel 22 thus extends downwardly through sleeve 28, through upper expander 56, through upper and lower slips 52 and 54, and through the lower expander 58. The setting sleeve SS, as shown in FIG. 3, thus abuts shoulder 66 of collar 38, and transmits a relative downwardly directed force applied by setting sleeve SS to collar 38, to sleeve 28 and then to the upper expander 56 that is fixably secured to sleeve 28 by threads 60. As explained further below, this axially directed force shears upper expander shear screw 57, then subsequently lower expander shear screw 59.

The setting tool ST thus sets the anchor mechanism by applying a downwardly directed force on upper expander 56 which, after the shearing of upper shear screw 57, is axially movable with respect to lower expander 58. Although lower expander 58 is also axially movable along mandrel 22, the application of forces exerted by the setting tool effectively moves the mandrel 22 and the lower expander 58 upward relative to the sleeve 28 since the mandrel 22 and lower expander 58 are still releasably connected by the lower shear screw 59. The upper expander 56 and lower expander 58 are thus forced to move axially toward each other by the operation of setting tool ST. As lower expander 58 and upper expander 56 move toward each other, upper and lower slips 52 and 54 are forced radially outwardly to engage casing C, as shown generally in FIG. 2, after which continued operation of the setting tool ST will cause the shearing of lower shear screw 59 and commence setting of the packoff mechanism 14 as will be hereinafter explained in detail. After both the anchor mechanism 12 and the packoff mechanism 14 are set (the packoff mechanism setting is described below), the shear stud 26 (see FIG. 3) may be broken at its weak point. After shear stud 26 breaks to end the setting operation, the setting tool ST may be retrieved upwardly towards the surface through the casing C and tubing T, as shown in FIG. 2.

Figure 6:
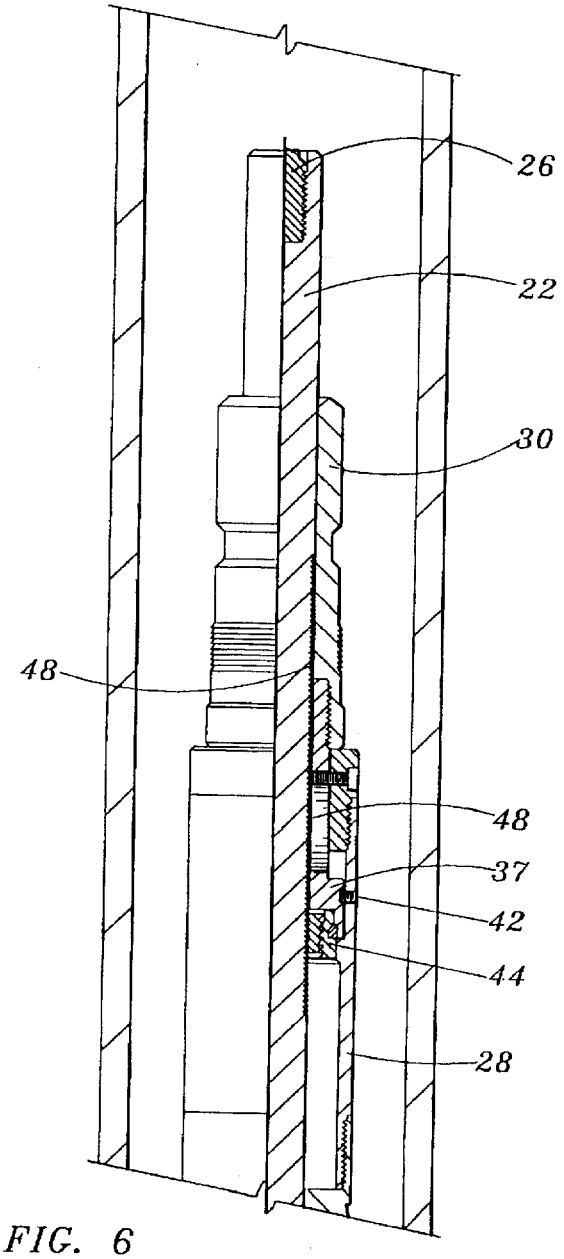
FIG. 6 is a detailed view of the upper portion of the bridge plug assembly disconnected from the setting tool after the bridge plug assembly has been set in the casing string.

It will be observed by comparison between FIG. 3 and FIG. 6 that mandrel 22 has moved upward relative to sleeve 28 during the setting process. Upper and lower slips 52 and 54, respectfully, remain engaged against casing C after shearing of shear stud 26 because mandrel 22 is secured in place by flexible ratchet ring 46. Ratchet ring 46 thus engages mandrel external buttress threads 48 to prevent mandrel 22 from moving downwardly, with respect to upper and lower slips 52 and 54, after shear stud 26 is sheared, thereby retaining the slips 52 and 54 in engagement with casing C.

Upper and lower opposed slips 52 and 54 are independently radially movable outwardly and inwardly. The slips are secured against casing C by means of relatively sliding members, discussed hereinafter, that slide upon each other in response to the relative movement of lower expander 58 in a direction toward upper expander 56, thereby forcing upper and lower slips 52 and 54 radially outwardly.

Referring to FIG. 4, the uppermost and lowermost relatively sliding members will be referred to as upper and lower outer expanders, 68 and 70, respectively. Adjacent to these are upper and lower inner expanders, 72 and 74, respectively. Upper and lower inner expanders 72 and 74 are slidably secured to upper and lower slips 52 and 54, respectively, by a dovetail slotted key interconnection. Specifically, the relative slidable interconnections between each of the expanders as well as between the inner expanders and the slips may include at least one key having a dovetail profiled cross section. One and typically two keys may be integrally formed or secured with screws or by welding to the lower or radially inwardly side of each expander and each slip. The relative profile of the dovetail keyed slot interconnection is functionally similar to that of the interconnection between the slip links discussed hereinafter. The dovetail keys are secured within the upper and lower slots 76 and 78, respectively, that are provided between the expander and slip elements. The dovetail profile of mating keys and slots in combination with upper limit pins 77 and lower limit pins 79 within the limiting slots 71 secure the expanders and slips together to thereby prevent relative disengagement of these components from each other. The dovetail keyed slot interconnection also allows relative substantially longitudinal or axial sliding movement between these components while preventing relative rotation of the expanders and slips.

Upper and lower inner slip links 80 and 82 are each slidably secured to slip cage 84, and are spaced axially between the slip cage 84 and the respective upper and lower slips 52 and 54. Upper and lower middle slip links 86 and 88, respectively, are slidably secured to the respective inner slip links. Upper and lower outer slip links 85 and 87, respectively, are slidably secured between the respective middle slip links and the respective upper and lower slips 52 and 54. Since they are all interconnected to the slip cage 84, the slip links assure substantively uniform radial outward movement of each of the circumferentially spaced upper slips 52 or lower slips 54.

The upper and lower slip assemblies thus include the upper and lower expanders, the upper and lower slip links, and the separate upper and lower slips. Due to their separate connection to slip cage 84, these slip assemblies function substantially independently from each other during setting and unsetting functions. Thus, lower slips 54 and upper slips 52 engage and disengage casing C independently from each other as lower expander 58 and upper expander 56 move toward or away from each other. This feature results in the reliable settings of the anchor slips such that the anchor central axis 90 remains aligned with the axis of the casing. The independent disengagement of the slips also allows for the unsetting and retrieval of the anchoring mechanism, as explained hereafter.

Figure 7:
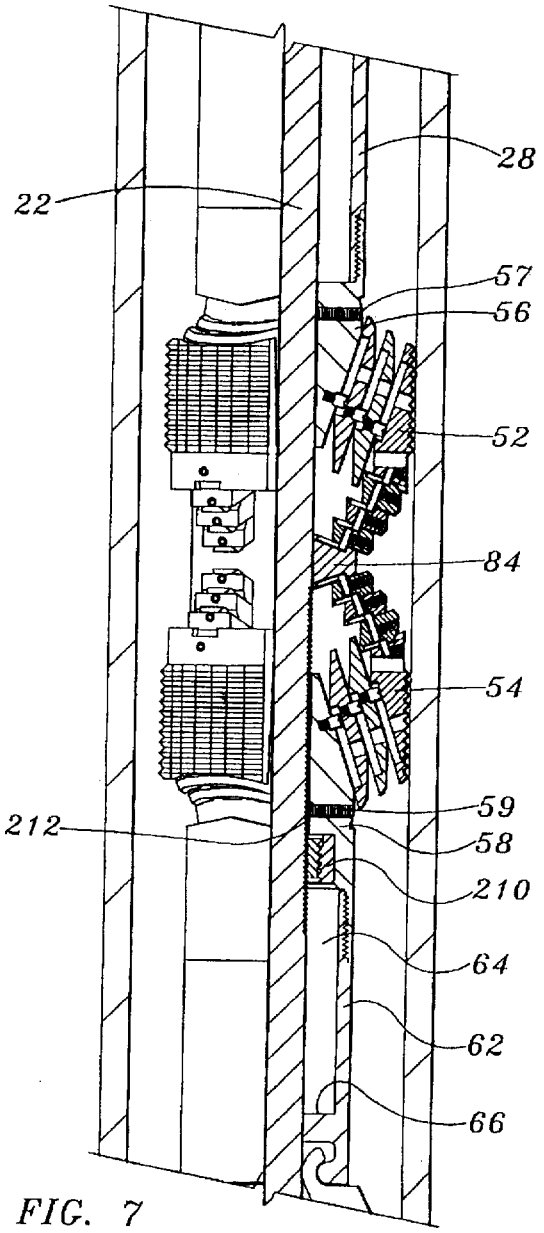
FIG. 7 is a detailed view of the anchor mechanism in the set position.

The upper slip assembly components including expanders, slip links, sliding surfaces, and slips essentially mirrors the construction of the lower slip assembly components expanders, slip links, sliding surfaces and slips. For convenience, discussion of the lower slip assembly components thus also applies to the upper slip assembly components unless otherwise noted. FIG. 4 shows the slip components in the unset or retracted position, while FIG. 7 shows the slip components in the set position.

The expanders, slip links, and slips slide with respect to each other on surfaces that are angled or inclined with respect to the tool centerline 90 so that as lower expander 58 and upper expander 56 move towards each other, the expanders, slip links, and slips are wedged or urged radially outwardly towards casing C. The magnitude of the angle of the relative sliding surfaces of the upper and lower slip assemblies with respect to the centerline 90 is preferably the same, although the orientation of measurement of the magnitude of the angle of the upper assembly sliding surfaces is in an opposing direction compared with the lower assembly sliding surfaces.

The construction of the inclined surfaces between the expanders is discussed in U.S. Pat. No. 5,566,762 and is therefore only briefly reviewed here. The inclined, curved surfaces on the expanders are substantially parallel for each axially neighboring expander on the same slip assembly and are preferably of a continuous uniform radius or curvature. In other words, a cross-section perpendicular to central axis 90 through corresponding portions of axially neighboring expanders will show curved but parallel relative sliding surfaces. Vertical cross-sections of axially neighboring expanders will show substantially straight and parallel relative sliding surfaces.

In cross-sections perpendicular to the centerline 90 of the tool, it should be understood that the circumferentially spaced sliding surfaces between the expanders lie along the circumference of a circle, and are not conical. Such a cross-section perpendicular to the tool centerline shows these surfaces lying on rounded lobes that would connect, for instance, in triangular fashion the three sets of circumferentially spaced lower slip assemblies. Because the expanders absorb large radial forces during setting and while the anchor is set, the expanders preferably collectively have a surface area that substantially extends around the circumference of anchor mechanism 12 when in the collapsed position to minimize the radial force applied per square inch to the inner and outer surfaces of the expanders.

By way of example, lower expander inclined surface 92 on lower expander 58 engages mating lower outer expanders internal surface 94 on outer expander 70. Limiting slot 71 is disposed within lower outer expanders internal surface 94 and, in conjunction with limit pin 79, and limiting slot 71 limits the extent of sliding movement of lower outer expander 70 with respect to lower expander 58. Limiting slot 71 may be designed to limit movement of the lower outer expander both in the collapsed and expanded positions, as desired, by means of expansion limit shoulders.

Aperture 96 is provided through outer expander 70 to be in communication with limiting slot 71 as a convenience during assembly for inserting limit pin 79. Similar apertures are provided in inner expander 74 and lower slips 54 for similar assembly purposes. Mating sliding surfaces are similarly provided between outer expander 70 and inner expander 74. Separate from and circumferentially spaced on either side of the respective limit grooves are the dovetail keyed slots 76 and 78 discussed above. The dovetail keyed slots also have sliding surfaces that correspond in orientation to the mating inclined surfaces disposed between the expanders. The upper slip assembly components are similar to the lower slip assembly components described above.

The dovetail keyed slots and limit grooves in the slip links may be functionally combined. Set screw 98 fixably secures limit pin 100 within outer slip link 87 through a dovetail key. The dovetail key interconnects with a dovetail slot in the middle slip link 88 to slidably secure outer slip link 87 to middle slip link 88. FIG. 4 illustrates a typical limit groove 102 within middle slip link 88 for receiving limit pin 100. Limit pin 100 and limit groove 102 thus cooperate to limit the extent of respective sliding movement between outer slip link 87 and middle slip link 88 as desired. Each limit groove, such as limit groove 102, includes expanded and collapsed position limit shoulders to thereby limit the relative movement by the slip assembly between the expanded and collapsed position. For this purpose, the limit shoulders engage a corresponding limit pin, such as limit pin 100, to thereby limit the extent of sliding movement between slip links. Similar limit pins and limit grooves are provided between the outer slip link 87 and lower slips 54. It should be understood that other configurations for placement and receipt of the dovetail slots and keys could be made.

Relative sliding between the cage, slip links, and the slips occurs along inclined surfaces that, in the presently preferred embodiment, have a slip link inclination that is substantially orthogonal to the inclination of sliding surfaces between the expander members and the slips. Because the angle of inclination between the centerline of anchor mechanism 12 and the expander inclination is much smaller than that of the slip link inclination, the expanders tend to absorb substantially all of the forces that cause the slips to engage against casing C. The radial setting forces are quite large and are therefore better absorbed by the larger surface areas of the expanders as compared to the slip links. The expanders are disposed radially inwardly between the slips when anchor mechanism 12 is set, as shown in FIG. 7. For instance, when anchor mechanism 12 is set, lower expander 58 is beneath and radially inwardly with respect to outer expander 70, inner expander 74 and slip 54 to thereby support the radial forces. Because the forces to be absorbed by the slip links tend to be axially directed rather than radially directed, the sliding surfaces of the slip links may be conveniently substantially flat rather than radiused. The slip links may be axially spaced from the slips whether in the set or unset position because they do not transmit substantial radial forces. The side portions of all the dovetail keys and slots on all slip assembly components tend to absorb most of the rotational forces that may act on anchor mechanism 12 to prevent rotation thereof with respect to casing C. The sliding surfaces of the slip links and related surfaces on cage 82 and slips are preferably parallel to each other and, in the presently preferred embodiment, include surfaces on the dovetail slots and keys, as discussed hereinbefore, as well as surfaces adjacent thereto.

Figure 5:
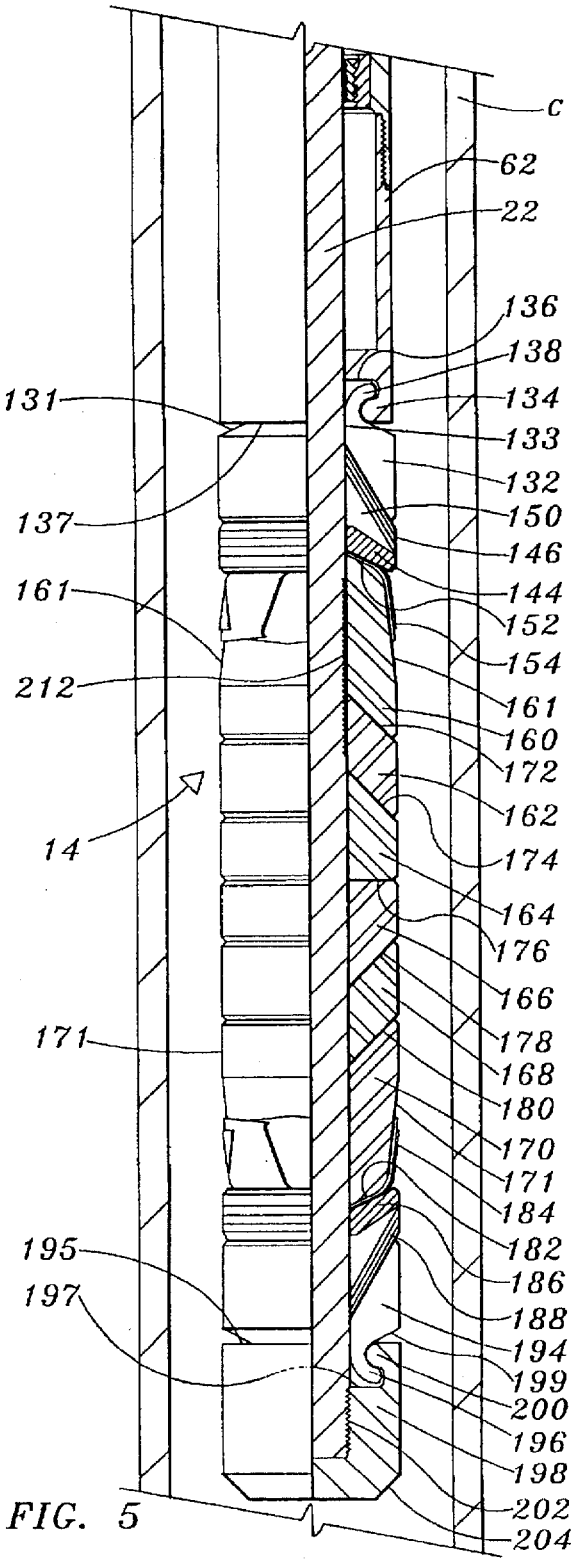
FIG. 5 is a detailed view of the packoff mechanism in the run-in or unset position.
Figure 8:
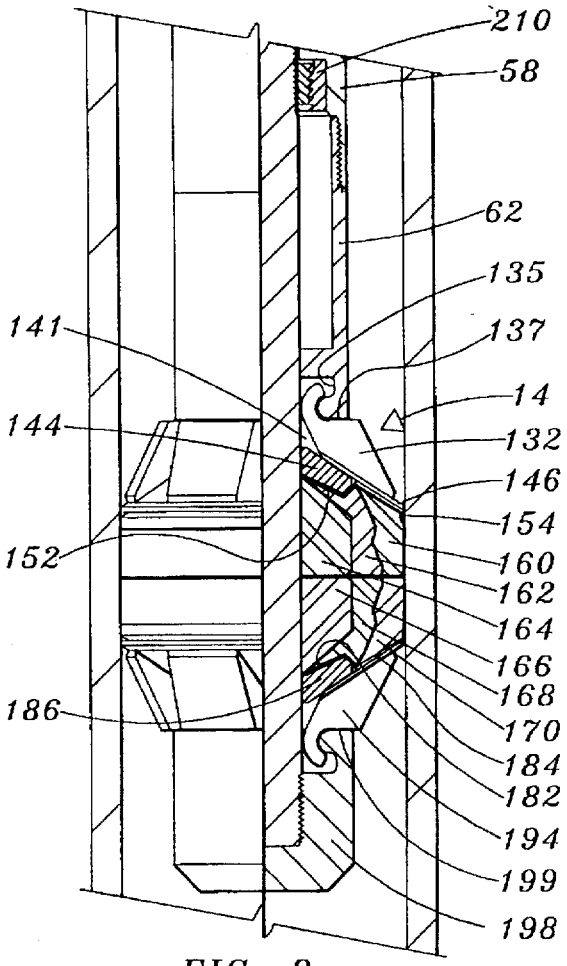
FIG. 8 is a detailed view of the packoff mechanism in the set position.

FIGS. 5 and 8 illustrate in greater detail the packoff mechanism 14 generally shown in FIGS. 1 and 2. The lower end of housing sub 62 is provided with a stop surface 136 and a lower projection 134 which extends radially inward and has a curved interior surface. A plurality of circumferentially spaced rigid upper pivot members 132 each include an upper projection 138 which extends radially outward into an annular recess 135 provided between the stop surface 136 and projection 134. A curved exterior surface on projection 138 mates with a similar curved surface on projection 134 to allow pivoting movement of each member 132 from the unset position as shown in FIG. 5 to the set position as shown in FIG. 8. Angled shoulders 131 extend outward from the upper projections 138 of the upper pivot members 132 and limit rotational or pivotal movement of pivot members 132 as they abut the limit shoulder 137 of lower projection 134.

Figure 9:
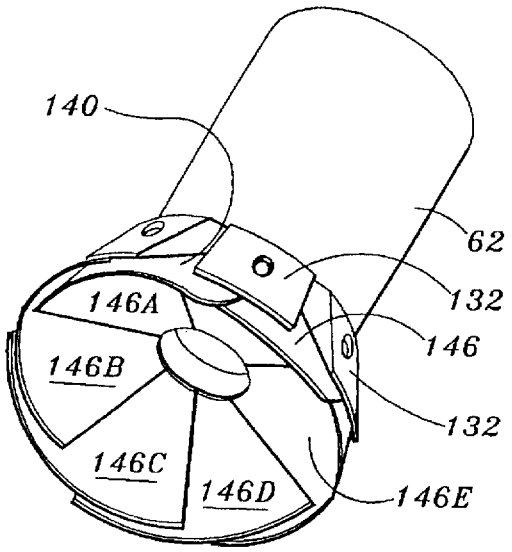
FIG. 9 is a pictorial view illustrating a plurality of circumferentially spaced upper pivot members and overlapping leaf members in their expanded or set position.
Figure 10:
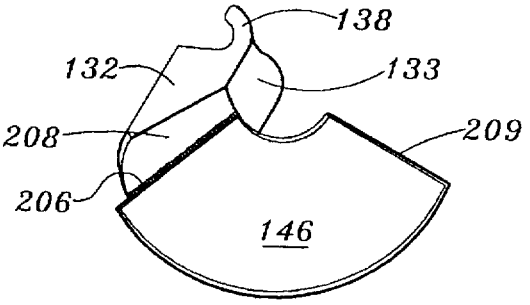
FIG. 10 is a pictorial view of one of the upper pivot members and leaf members depicted in FIG. 9.

Upper slanted ring 144 is slidably positioned on mandrel 22. Deformable leaf members 146 are affixed at 206, as shown in FIG. 10, to the rigid pivot members 132 and positioned between the rigid pivot members 132 and the slanted ring 144 as shown in FIG. 5. Leaf members 146 are circumferentially formed to overlap several pivot members 132 in the run-in position and are deformed during the setting operation so as to overlap at least one, and preferably two, of the outer gaps 140, as shown in FIGS. 9 and 10, which develop between pivot members 132. For the run-in position as shown in FIG. 5, an annular recess 150 having a triangular cross-sectional configuration is formed between the leaf members 146 and the slanted ring 144. The triangular cross-sectional configured area 150 is displaced by the slanted ring 144 upon setting of the bridge plug 10 in order for the slanted ring 144 to close the inner gap 141 between the rigid pivot members 132 which were created upon pivoting of the pivot members 132. A single anti-extrusion ring 152 comprising a plurality of overlapping deformable outer segmented edges 154, which are deformed to encapsulate the outer conical surface 161 of sealing member 160 during the run-in position shown in FIG. 5, is provided below the slanted ring member 144. The outer segmented edges 154 effectively form an upper deformable sheet or cup which is expanded or flared into contact with the casing C when the bridge plug 10 is set and serve to assist in retaining the configuration of the upper elastomeric annular sealing member 160 when the bridge plug 10 is set in the well.

The lower conical-shaped surface of the elastomeric sealing member 160 and the upper mating surface of the intermediate sealing member 162 form a slanted conical interface 172. A similar slanted conical interface 174 is formed between the lower surface of the intermediate sealing members 162 and the central sealing member 164. The sealing mechanism 14 includes similar central sealing member 166, an intermediate sealing member 168, and a lower sealing member 170 with engagement surfaces or interfaces 178 and 180 between these members, respectively. Horizontal planar engaging surface 176 acts between the lower surface of sealing member 164 and upper surface of sealing member 166. Lower mechanisms 182, 184, 186, and 188 are mirror images of similar components discussed above. The lower sub 198 is threaded at 202 to mandrel 22, and includes a rigid upper projection 200 similar to projection 134. A plurality of circumferentially spaced rigid pivot members 194 each have a projection 196 which is functionally similar to projection 138 on the upper pivot members 132. The lowermost portion of sub 198 includes a bevel 204 for facilitating the lowering of the tool 10 into the casing C.

Referring to FIGS. 1, 2, and 8, it may be seen that the downward movement of the housing sub 62 with respect to mandrel 22 results in shearing of the lower shear screw 59 and results in the pivoting of upper members 132 and lower members 194. The sealing members are axially compressed between stop surface 136 on housing sub 62 and stop surface 197 on sub 198 during the setting operation. Overlapping upper leaf members 146 and the similar lower leaf members 188 are welded at 206 (see FIG. 10) or otherwise secured to the lower and upper inclined and slightly curved surfaces of the members 132 and 194, respectively, and during this pivotal movement these leaf members extend radially outward to engage or at least be substantially adjacent the interior surface of the casing C. The pivot members 132 and 194 radially retain the sealing members, and particularly members 160 and 170, in position during run-in of the pack-off mechanism. During setting, the pivot members 132 and 194, in cooperation with the slanted interfaces 172, 174, 178 and 180, thus typically result first in radial expansion and axial movement of the elastomeric members 160 and 170, then further radial expansion and axial movement of elastomeric members 162 and 168.

During the setting operation, the outer segmented edges 154 of upper anti-extrusion ring 152 and the outer edges 184 of lower anti-extrusion ring 182 wrap partially around the radially outward surface of the respective slanted ring member 144 and 186, then deform to provide substantially planar-to-planar engagement with the respective leaf members 146 and 188. Each of the uppermost sealing member 160 and the lowermost sealing member 170 expand radially outward and are pressed axially toward each other to overlap the respective intermediate sealing members 162 and 168, and these intermediate sealing members 162 and 168 then expand radially outward and are pressed axially toward each other to overlap the respective central sealing members 164 and 166. Those skilled in the art will appreciate that some expansion and axial movement of intermediate sealing members 162 and 168 may occur before sealing members 160 and 170 are each fully radially outward of and overlap sealing members 162 and 168. When in the fully set position as shown in FIG. 8, however, at least a substantial portion of the upper sealing member 160 is radially outward of the intermediate sealing member 162, and in turn at least a portion of member 162 is radially outward of the central sealing member 164. Similarly, at least a substantial portion of lower sealing member 170 is radially outward of the intermediate sealing member 168, and at least a substantial portion of sealing member 168 is radially outward of and overlaps central sealing member 166.

It should be understood that the elasticity of each of the sealing members 160, 162, 164, 166, 168 and 170 are preferably maintained to accomplish first the radially outward expansion of the relatively pliable or elastic sealing members 160 and 170 so that these members slide along the respective engaging surfaces 172 and 180 to overlap the respective intermediate sealing members 162 and 168. The intermediate sealing members 162 and 168 have a moderate degree of elasticity and are significantly less pliable than the members 160 and 170, so that these sealing members 162 and 168 slide along the respective interfaces 174 and 178 and both expand radially outward and move axially together until the sealing mechanism 14 achieves the position substantially as shown in FIG. 8. The sealing members 164 and 166 are less elastic than sealing members 162 and 168.

Figure 11:
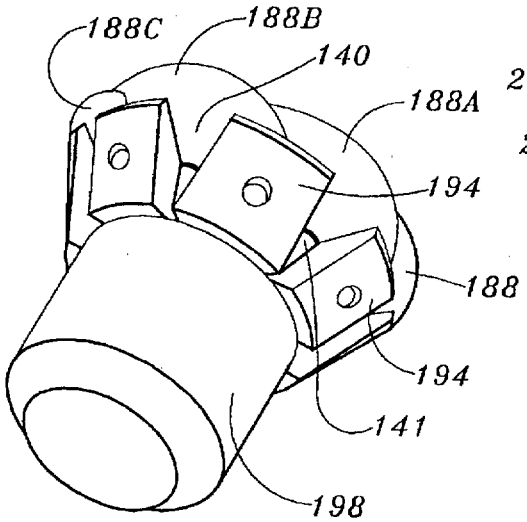
FIG. 11 is a pictorial view illustrating a plurality of circumferentially spaced lower pivot members and overlapping leaf members in their expanded or set position.

FIGS. 9, 10, and 11 provide further details with respect to the circumferentially spaced and rigid upper pivot members 132 and the similar lower pivot members 194. It may be seen that as these members pivot radially outward, the gap 140 or spacing between the adjacent surfaces of the pivot members inherently increases or widens toward the inside diameter of casing C as the tool is set. In the area immediately radially outward from the mandrel 22, this gap is filled with the rings 144 and 186, respectively. Leaf members 146 and the similar circumferentially spaced leaf members 146A, 146B etc. preferably provide substantial overlap so that two such leaf members extend between the gap between each of the adjacent pivot members 132 when the pivot members are moved to their fully expanded position. Each leaf member thus preferably extends circumferentially along the gap between an adjacent pivot member, across that adjacent pivot member, and across the gap between that adjacent pivot member and the next pivot member, so that its extended end surface is supported by the next pivot member. These leaf members 146 and 188 are preferably formed from a malleable or deformable material, such as sheet copper, and typically have a thickness of from 0.06 to 0.08 inches. The leaf members 146 and 188 thus provide a substantial backup to prevent extrusion of the sealing members between the pivot members. This extrusion is further prevented by the upper and lower anti-extrusion rings 152 and 182 and their respective outer segmented edges 154 and 184. These rings may also be formed from copper or another easily deformable material, and bend to provide substantially planar-to-planar engagement with the leaf members to further prevent extrusion of the sealing members between the pivot members during the setting operation.

FIG. 10 shows a suitable pivot member 132 with upper projection 138 as discussed above. Interior surface 133 of pivot member 132 is formed for substantially planar engagement with the outer cylindrical surface of the mandrel 22 when in the run-in position. One of the leaf members 146 is shown with its edge welded or soldered at 206 to the tapered surface 208 of pivot member 132. The circumferentially opposing edge 209 of leaf member 132 thus slides along another leaf member as the sealing mechanism expands to the position as shown in FIG. 8. This edge 209 is the end surface which is supported by another upper pivot member circumferentially separated from the pivot member to which the leaf member is secured by an intermediate pivot member, thereby achieving the overlap of two leaf members between the fully set pivot members.

FIG. 11 illustrates similar circumferentially spaced lower pivot members 194 and the overlapping leaf members 188, 188A, 188B, and 188C. In a preferred embodiment of the invention, the number of pivot members may vary, dependent upon size, but the pivot members are circumferentially spaced about both housing sub 62 and lower sub 198, and each pivot member has a respective leaf member secured thereto in the manner similar to that shown in FIG. 10. Those skilled in the an will appreciate that the numbers of pivot members, leaf members and anti-extrusion rings will depend on the application.

Once the bridge plug assembly 10 has been set as shown in FIG. 2, and more specifically as shown in FIGS. 7 and 8, the sleeve 28 will have moved downward relative to the mandrel 22, so that ratchet ting housing 44 engages buttress threads 48 on the exterior surface of the mandrel. A subsequent stroking of the setting tool ST will shear the stud 26, thereby allowing release of the setting tool ST from the set bridge plug 10, as shown in FIG. 2. Forced interference of the components as shown in FIGS. 5 and 8 prevents subsequent upward movement of the mandrel 22 relative to the sleeve 28, and ratchet ring 46 prevents inadvertent downward movement of the mandrel 22 relative to the sleeve 28 which is necessary for the release of the bridge plug assembly.

Figure 12:
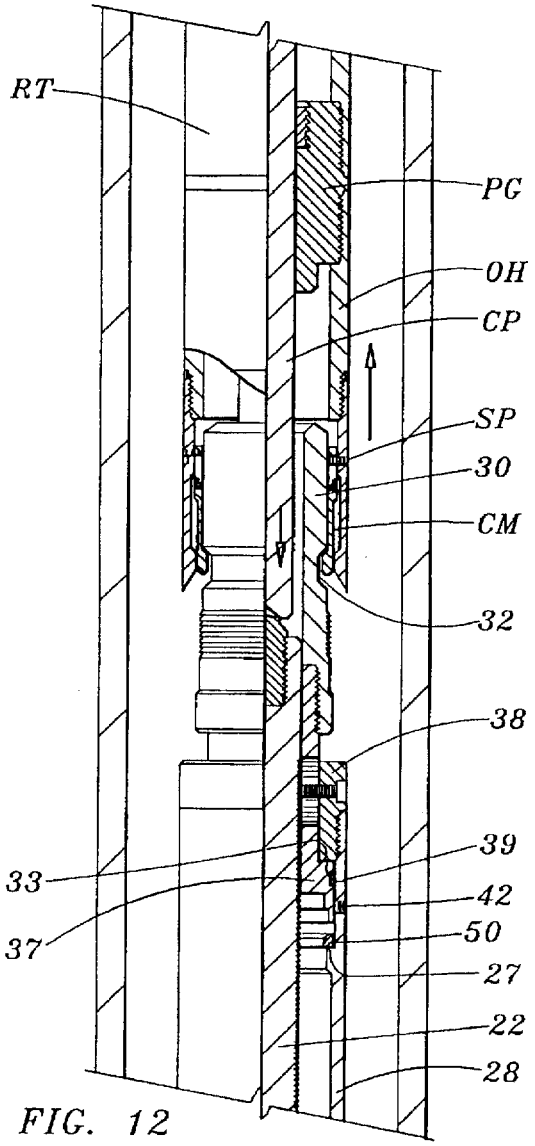
FIG. 12 is a detailed view of the upper portion of the bridge plug assembly during unsetting of the bridge plug assembly by a releasing tool.
Figure 13:
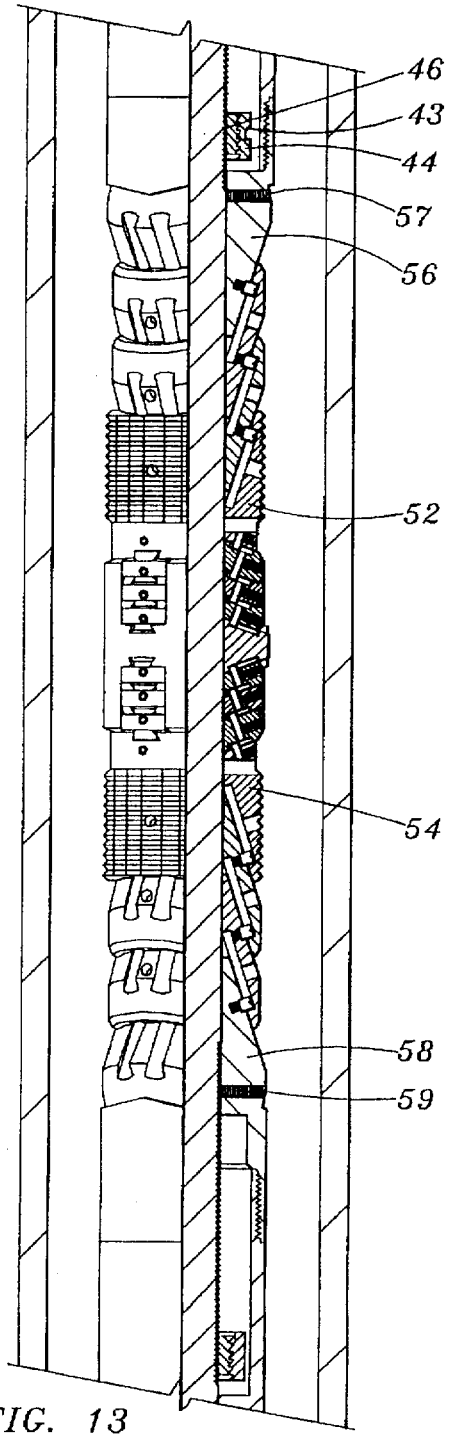
FIG. 13 illustrates the anchor mechanism after being released from gripping engagement with the large diameter casing string.

Referring now to FIGS. 2, 12, 13 and 14, the procedure for unsetting the bridge plug assembly 10 will be described. FIG. 6 shows ratchet ring housing 44 in its locked position after setting. Shear screw 42 secures releasing sleeve 37 in this axial position with respect to sleeve 28. Ratchet ring 46, contained in housing 44, engages buttress thread 48 to prevent axially downward movement of mandrel 22, thereby locking mandrel 22 in a fixed axial position with respect to sleeve 28. To release the bridge plug assembly 10, a releasing tool RT as shown in FIG. 12 may be lowered from a work string WS. The releasing tool RT includes outer housing OH, central plunger CP, and plunger guide PC. A collet mechanism CM is provided at the lower end of the outer housing for interconnection with annular retrieving groove 32 in top sub 30.

As the outer housing OH is moved upwardly, along with the collet mechanism CM, top sub 30 and releasing sleeve 37, while the central plunger CP is moved downward on the mandrel 22, along with the ratchet ring 46, ratchet ring housing 44, C-ring 50 and sleeve 28, the shear pin 42 will be sheared at a preselected force. Shearing of the shear screw 42 permits the releasing sleeve 37 to shift or move upward, relative to the sleeve 28, until the enlarged annular shoulder 33 of releasing sleeve 37 contacts the lower end 39 of collar 38. Since the C-ring 50 is retained within the annular groove 43 on ratchet ring housing 44, the lower end of the housing, including its lower annular recess, is moved from its encircling position adjacent the C-ring 50. This movement permits the C-ring 50, which is overlapped with reduced annular shoulder 27 of sleeve 28, to be lifted from the annular groove 43 of ratchet ring housing 44 by the radially outward biased upper edge of the annular groove 43. Release of the C-ring 50 from its locked position in the external annular groove 43 of the ratchet ring housing 44 permits the sleeve 28 to move upward relative to the mandrel 22 and ratchet ring 46 with affixed ratchet ring housing 44. Continuation of this movement, through operation of the releasing tool RT, causes the upper expander 56 to move away from the lower expander 58 to unset the upper and lower slip assemblies. Operation of the ratchet ring assembly (ratchet ring 46, ratchet ring housing 44 and buttress thread 48 on mandrel 22) is similar to the ratchet ring system shown in U.S. Pat. No. 4,898,245 and incorporated herein by reference.

In response to forces applied through the releasing tool RT, an upwardly directed unsetting force is applied to upper expander 56 through sleeve 28, as shown in FIG. 12. Relative sliding between upper slip assembly components, in a direction opposite to the movement caused by the setting operation, causes upper slips 52 to move radially inwardly. The use of slip cage 84 slidably secured to mandrel 22 allows the upper slips 52 to move independently of opposing lower slips 54. A continued upwardly directed force on cage 84 produces a radially inwardly directed force on the lower slip assembly components to release lower slips 54. Gravity and momentum forces acting on mandrel 22 and lower expander 58 also cause lower expander 58 to move relatively away from upper expander 52 to release lower slips 54.

When the bridge plug assembly 10 is set and the ratchet ring 46 as shown in FIG. 6 is in engagement with the external buttress thread 48 on mandrel 22, a lower ratchet ring assembly 210 (including a housing) is also in engagement with lower buttress threads 212 on the mandrel 22, as shown in FIG. 7. As the releasing tool RT continues to stroke in unsetting the bridge plug assembly 10 after release of the anchor mechanism 12, the ratchet ring assembly 210, which is locked to mandrel 22, moves downward within the internal upper annular recess 64 of housing sub 62 until the ratchet ring assembly 210 contacts annular shoulder 69 of housing sub 62. Prior to contact of the annular shoulder 69 by the ratchet ring assembly 210, the continued action of the releasing tool RT causes the mandrel to be lowered, relative to the previously released or unset components of the bridge plug assembly 10, to move or lower the lower sub 198 away from its previous position adjacent the set sealing members 160, 162, 164, 168, and 170. It may be seen in FIG. 14 that the pivot members 132 and 194 return partially toward their run-in position. Leaf members 146, 148 and anti-extrusion rings 152, 182 retain much of their deformed configuration. Due to the memory of the elastomers, the sealing members 160, 162, 164, 166, 168, and 170 may return to a position substantially similar to that shown in FIG. 14.

Figure 15:
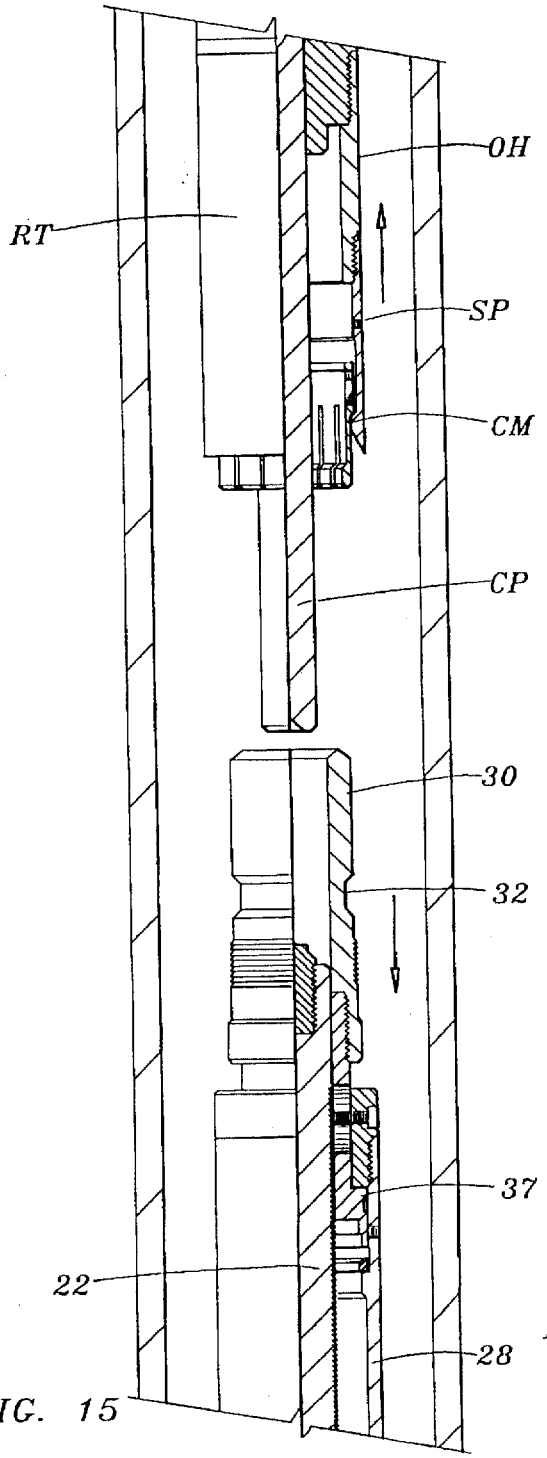
FIG. 15 illustrates the release of the unsetting tool from the upper portion of the bridge plug assembly.
Figure 14:
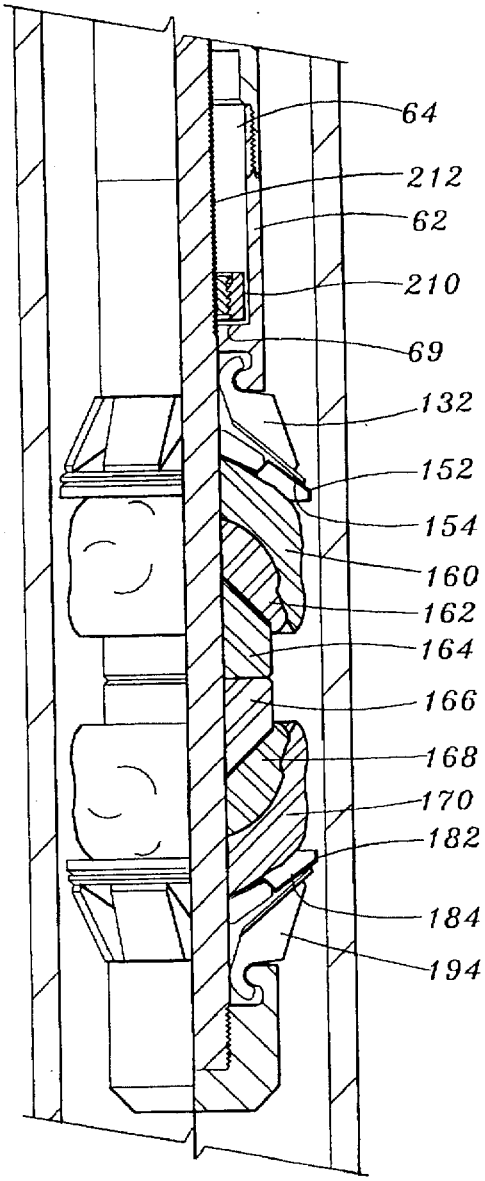
FIG. 14 illustrates the packoff mechanism after being released from sealing engagement with the large diameter casing string.

Once the bridge plug assembly 10 has been unset, the releasing tool RT may be released from the bridge plug assembly immediately, or both the releasing tool RT and bridge plug assembly 10 may either be moved to another location within the casing C, and may be released or ejected from one another by exerting an additional increased downward force on the outer housing OH to shear the shear pin SP (see FIGS. 12 and 15). Subsequent upward movement of the outer housing OH will allow the collet mechanism CM to disengage from the retrieving groove 32 of the bridge plug's top sub 30, thereby allowing the bridge plug assembly 10 to drop within the wellbore while the releasing tool RT is retrieved to the surface through the casing C and tubing T. It should be noted that if the bridge plug 10 is to be moved to another location within the casing C, the lower ratchet ring assembly 210, locked to the lower buttress threads 212 on mandrel 22 and in contact with annular shoulder 69 of housing sub 62, prevents lower expander from moving upward axially toward upper expander 56 which could result in resetting of the slips 52 and 54.

While the foregoing is the presently preferred embodiment of the present invention, numerous changes could be made as desired. For instance, a setting mechanism such as a mechanical setting mechanism could be used to set the bridge plug 10 instead of the preferred hydraulic setting tool. The relative angles of the sliding surfaces of the anchor mechanism 12 may be changed as desired. Additional sliding surfaces may be added or removed to either extend or decrease the expansion range of the slips of anchor mechanism 12. The packoff mechanism 14 includes a plurality of upper elastomeric members, each having a selected varying degree of elasticity, and a plurality of similar lower elastomeric members. Three upper elastomeric members and three lower elastomeric members are preferred for the application described herein, although the selected number and the degree of elasticity of the elastomeric members will depend on the application. While both a plurality of upper and a plurality of lower elastomeric members are preferred, in some applications only a plurality of either upper or lower elastomeric members may be required. Selection of both the thickness and the number of leaf members and anti-extrusion rings will also depend on the application. In some cases, the anti-extrusion rings may not be required.

The bridge plug assembly, as disclosed herein, is well suited for use in substantially vertical wells as well as highly deviated and horizontal wells which frequently require setting of a bridge plug in a casing having a smaller diameter tubular terminating in the well above the depth where the bridge plug is to be set. The bridge plug mechanism preferably includes an anchor mechanism as described herein to axially and rotationally secure the bridge plug to the interior wall of the casing. In some applications, the assembly may contain a mandrel having an internal flow passage and a mechanism for connecting downhole flow control chokes or other devices in a manner well known in the art.

The foregoing disclosure and description of the invention is illustrative and explanatory thereof. It will be appreciated by those skilled in the art that various changes in the size, shape and materials, as well as in the details of the illustrated construction or combinations of features of the various anchor mechanism and pack-off mechanism may be made without departing from the spirit of the invention., which is defined by the claims.

What is claimed is:

1. A compression set bridge plug positionable within a wellbore from a wellbore transport member, the bridge plug comprising:

a slip cage supported from the wellbore transport member;

a first body portion and a second body portion each moveable with respect to said slip cage;

a first plurality of sliding members secured to said first body portion, each of said first plurality of sliding members being slidably movable with respect to others of said first plurality of sliding members between a set position and an unset position;

a second plurality of sliding members secured to said second body portion, each of said second plurality of sliding members being slidably movable with respect to others of said second plurality of sliding members between a set position and an unset position;

a first plurality of slip members each being radially moveable between a set position and an unset position in response to slidable movement of the first plurality of sliding members;

a second plurality of slip members each being radially movable between a set position and an unset position in response to slidable movement of the second plurality of sliding members;

a plurality of elastomeric sealing members radially movable between a set position for sealing engagement with the interior surface of the wellbore and an unset position; and a releasable connection for releasing said bridge plug from said wellbore transport member when said first and second slip members and said plurality of sealing members are in a set position.

2. The bridge plug as defined in claim 1, wherein said plurality of elastomeric sealing members comprises:

a plurality of upper sealing members each having a different elasticity; and a plurality of lower sealing members each having a different elasticity.

3. The bridge plug as defined in claim 1, further comprising:

a plurality of upper pivot members for radially retaining an upper one of the plurality of upper sealing members to overlap another of the plurality of upper sealing members; and a plurality of lower pivot members for radially retaining a lower one of the plurality of lower sealing members to overlap another of the plurality of lower sealing members.

4. The bridge plug as defined in claim 3, further comprising:

a plurality of upper leaf members each secured to one of the plurality of upper pivot members and extending circumferentially from a respective secured upper pivot member for filling a gap between adjacent upper pivot members when pivoted to the set position; and a plurality of lower leaf members each secured to one of the plurality of lower pivot members and extending circumferentially from a respective secured lower pivot member for filling a gap between adjacent lower pivot members when pivoted to the set position.

5. The downhole bridge plug as defined in claim 3, further comprising:

an upper ring member spaced axially between the plurality of upper pivot members and the plurality of elastomeric sealing members;

an upper deformable sheet for filling a gap between upper pivot members when in the set position;

a lower ring member spaced axially between the plurality of lower pivot members and the plurality of elastomeric sealing members; and a lower deformable sheet for filling a gap between lower pivot members when in the set position.

6. The bridge plug as defined in claim 1, further comprising:

a releasable lock for locking said first plurality of sliding members in said set position, said releasable lock being releasable to allow said first plurality of sliding members to move back to said unset position.

7. The bridge plug as defined in claim 1, further comprising:

a first inclined sliding surface between an engaging pair of said first plurality of sliding members; and a second inclined sliding surface between an engaging pair of said first plurality slip members, said first inclined surface and said second sliding surface being substantially oriented perpendicular with respect to each other.

8. The bridge plug as defined in claim 1, further comprising:

a plurality of keys each disposed in a respective slot between each of said first plurality of sliding members.

9. The bridge plug as defined in claim 1, further comprising:

said slip cage being disposed between said first plurality of slip members and said second plurality of slip members to allow independent relative radial movement of said first slip and said second plurality of slip members.

10. A method for setting a compression set bridge plug in a first tubular disposed in a wellbore including a second tubular having an internal diameter less than said first tubular, the second tubular terminating at a lower end, the method comprising:

passing the compression set bridge plug through the second tubular and to a selected position within the first tubular below the lower end of the second tubular;

moving an upper plurality of slip members and a lower plurality of slip members radially outward to grippingly engage the first tubular; and applying a compressive force to move one or more sealing members radially outward to seal the one or more sealing members with the first tubular.

11. The method as defined in claim 10, further comprising:

providing a plurality of axially spaced upper sealing members and a plurality of axially spaced lower sealing members, each of the plurality of upper sealing members and each of the plurality of lower sealing members having a different selected elasticity compared to other of the upper sealing members and lower sealing members, respectively; and applying the compressive force moves one of the upper sealing members and one of the lower sealing members into sealing engagement with the first tubular.

12. The method as defined in claim 11, further comprising:

radially expanding at least one of the plurality of upper sealing members while moving the expanded at least one upper sealing member axially such that at least a substantial portion of the at least one expanded upper sealing member is radially outward of another of the plurality of upper sealing members; and radially expanding at least one of the plurality of lower sealing members while moving the expanded at least one lower sealing member axially such that at least a substantial portion of the at least one expanded lower sealing member is radially outward of another of the plurality of lower sealing members.

13. The method as defined in claim 10, further comprising:

providing a plurality of upper pivot members for radially retaining the upper sealing member; and providing a plurality of lower pivot members for radially retaining the lower sealing members.

14. The method as defined in claim 13, further comprising:

securing each of a plurality of upper leaf members to one of the plurality of upper pivot members and extending circumferentially from a respective secured upper pivot member for filling a gap between adjacent upper pivot members when pivoted to the set position; and securing each of a plurality of lower leaf members to one of the plurality of lower pivot members and extending circumferentially from a respective lower pivot member for filling a gap between adjacent lower pivot members when pivoted to the set position.

15. A method for positioning a compression set bridge plug in a first tubular disposed within a borehole containing a second tubular therein having a diameter less than the first tubular, the method comprising the steps of:

lowering the bridge plug through the second tubular, out a lower end of the second tubular, and into a first tubular;

radially expanding slips on the bridge plug to secure the bridge plug within said first tubular;

applying a compressive force to expand one or more sealing members on the bridge plug radially outward to sealingly engage the first tubular; and retracting the expanded slips and the one or more sealing members to release the bridge plug from the first tubular.

16. The method as defined in claim 15, wherein the step of radially expanding slips on a bridge plug further comprises:

expanding upper slips radially outwardly; and independently expanding lower slips radially outwardly.

17. The method as defined in claim 15, wherein the step of expanding slips further comprises:

supporting radial forces acting on each of the slips with a first plurality of slidable elements.

18. The method as defined in claim 15, further comprising:

providing a plurality of sealing members each having a different selected elasticity compared to other of the plurality of sealing members for expanding one of the plurality of sealing members radially outward relative to other of the plurality of sealing members in response to the compressive force.

19. The method as defined in claim 18, further comprising:

providing a plurality of axially spaced upper sealing members and a plurality of axially spaced lower sealing members, each of the plurality of upper sealing members and each of the plurality of lower sealing members having a different selected elasticity compared to other of the upper sealing members and lower sealing members, respectively.

20. The method as defined in claim 19, further comprising:

radially expanding at least one of the plurality of upper sealing members while moving the expanded at least one upper sealing member axially such that at least a substantial portion of the at least one expanded upper sealing member is radially outward of another of the plurality of upper sealing members; and radially expanding at least one of the plurality of lower sealing members while moving the expanded at least one lower sealing member axially such that at least a substantial portion of the at least one expanded lower sealing member is radially outward of another of the plurality of lower sealing members.

21. A method for positioning a compression set plug within a first tubular supported within a wellbore having therein a second tubular supported therein, the second tubular having an internal diameter less than the first tubular and having a lower end, the method comprising:

connecting the compression set plug to a wellbore transport and setting member;

passing said compression set plug and said wellbore transport and setting member through said second tubular and to a selected position within said first tubular below a lower end of the second tubular, applying an axially compressive force to expand one or more elastomeric sealing members radially outward to engage an inner wall of said first tubular;

locking the bridge plug in a set position with the elasometric sealing members engaging the first tubular; and disconnecting said compression set plug from the wellbore transport and setting member.

22. The method as defined in claim 21, further comprising:

expanding anchoring slips on said plug to engage an inner wall of said first tubular; and retracting said anchoring slips on said plug from said inner wall of said first tubular.

23. The method as defined in claim 22, wherein said step of retracting said setting slips further comprises:

retracting at least one upper slip; and independently retracting at least one lower slip.

24. The method as defined in claim 21, further comprising:

providing a plurality of sealing members each having a different selected elasticity compared to other of the plurality of sealing members for expanding one of the plurality of sealing members radially outward relative to other of the plurality of sealing members in response to the compressive force.

25. The method as defined in claim 24, further comprising:

providing a plurality of axially spaced upper sealing members and a plurality of axially spaced lower sealing members, each of the plurality of upper sealing members and each of the plurality of lower sealing members having a different selected elasticity compared to other of the upper sealing members and lower sealing members, respectively.

26. The method as defined in claim 25, further comprising:

radially expanding at least one of the plurality of upper sealing members while moving the expanded at least one upper sealing member axially such that at least a substantial portion of the at least one expanded upper sealing member is radially outward of another of the plurality of upper sealing members; and radially expanding at least one of the plurality of lower sealing members while moving the expanded at least one lower sealing member axially such that at least a substantial portion of the at least one expanded lower sealing member is radially outward of another of the plurality of lower sealing members.

27. The method as defined in claim 21, further comprising:

providing a plurality of pivot members for radially retaining at least one of the one or more sealing members.

28. The method as defined in claim 27, further comprising:

securing each of a plurality of leaf members to one of the plurality of pivot members and extending circumferentially from a respective secured pivot member for filling a gap between adjacent pivot members when pivoted to the set position.

29. The method as defined in claim 21, further comprising:

a ring member spaced axially between the plurality of pivot members and the one or more elastomeric sealing members.

30. A compression set plug for setting in a first tubular disposed in a wellbore including a second tubular having a diameter less than the first tubular, the plug being positioned in the first tubular suspended from a wellbore transport member by passing the plug and the well transport member through the second tubular and past a lower end of the second tubular for compression setting the plug in the first tubular, the plug comprising:

a plurality of axially spaced upper sealing members each having a different elasticity;

a plurality of axially spaced lower sealing members each having a different elasticity;

a plurality of upper pivot members for radially retaining an upper one of the plurality of upper sealing members to overlap another of the plurality of upper sealing members when in the set position;

a plurality of lower pivot members for radially retaining a lower one of the plurality of lower sealing members to overlap another of the plurality of lower sealing members when in the set position; and a releasable connection for releasing said compression set plug from said wellbore transport member when said plurality of upper and lower sealing members are in a set position.

31. The plug as defined in claim 30, further comprising:

a plurality of upper leaf members each secured to one of the plurality of upper pivot members and extending circumferentially from a respective secured upper pivot member for filling a gap between adjacent upper pivot members when pivoted to the set position; and a plurality of lower leaf members each secured to one of the plurality of lower pivot members and extending circumferentially from a respective secured lower pivot member for filling a gap between adjacent lower pivot members when pivoted to the set position.

32. The plug as defined in claim 30, further comprising:

an upper ring member spaced axially between the plurality of upper pivot members and the plurality of elastomeric sealing members;

an upper deformable sheet for filling a gap between upper pivot members when in the set position;

a lower ring member spaced axially between the plurality of lower pivot members and the plurality of elastomeric sealing members; and a lower deformable sheet for filling a gap between lower pivot members when in the set position.

33. The plug as defined in claim 30, further comprising:

a slip cage supported from the well transport member;

a first body portion and a second body portion each moveable with respect to said slip cage;

a first plurality of sliding members secured to said first body portion, each of said first plurality of sliding members being slidably movable with respect to other of said first plurality of sliding members between a set position and an unset position;

a second plurality of sliding members secured to said second body portion, each of said second plurality of sliding members being slidably movable with respect to other of said second plurality of sliding members between a set position and an unset position;

a first plurality of slip members each being radially moveable between a set position and an unset position; and a second plurality of slip members each being radially movable between a set position and an unset position.

34. The plug as defined in claim 33, further comprising:

a first inclined sliding surface between an engaging pair of said first plurality of sliding members; and a second inclined sliding surface between an engaging pair of said first plurality slip members, said first inclined surface and said second sliding surface being substantially oriented perpendicular with respect to each other.

35. The plug as defined in claim 33, further comprising:

said slip cage being disposed between said first plurality of slip members and said second plurality of slip members to allow independent relative radial movement of said first slip and said second plurality of slip members.

* * * * *